United States Patent [19]

Epple

[11] 4,181,825

[45] Jan. 1, 1980

[54] ELECTRIC SWITCH FOR MOTOR REVERSING

[75] Inventor: Peter C. Epple, Harper Woods, Mich.

[73] Assignee: General Motors Corporation, Detroit, Mich.

[21] Appl. No.: 912,293

[22] Filed: Jun. 5, 1978

[51] Int. Cl.[2] ..... H01H 9/00; H01H 21/68

[52] U.S. Cl. ..... 200/1 V; 200/6 B; 200/6 R; 200/16 C; 200/67 G; 200/153 K; 200/164 R; 200/242

[58] Field of Search ..... 200/1 R, 1 V, 5 R, 6 R, 200/6 B, 17 R, 18, 67 G, 164 R, 241, 242, 244, 335, 336, 339, 153 K

[56] References Cited

U.S. PATENT DOCUMENTS

| | | | |
|---|---|---|---|
| 2,807,684 | 9/1957 | Ayers | 200/6 R |
| 2,966,560 | 12/1960 | Gluck | 200/67 G X |
| 3,469,042 | 9/1969 | Sandor | 200/16 C |

*Primary Examiner*—James R. Scott
*Attorney, Agent, or Firm*—Donald F. Scherer

[57] ABSTRACT

The drawings illustrate a double pole, double throw switch for use in selectively controlling energization of either a first or second electric circuit. The switch includes two sets of first, second and third terminals, with each of the second terminals being offset in opposite directions from one another, and a pivotally mounted actuator button. A pair of legs are formed on the inner portion of the actuator button for carrying first and second contact strips, the latter being mounted for universal movement with respect to the second terminals so as to normally contact respective opposite first or third terminals. The legs are moveable in response to initial movement of the actuator button in either direction so as to selectively cause one of the first and second contact strips to pivot overcenter on the second terminal into engagement with the other of the first or third terminals to provide a conductive path between respective first or third terminals and thereby complete one of the first or second electric circuits. The legs are further moveable in response to continued movement of the actuator button so as to cause the first and second contact strips to slide across the respective first or third terminals in a cleaning action.

2 Claims, 5 Drawing Figures

ELECTRIC SWITCH FOR MOTOR REVERSING

BACKGROUND OF THE INVENTION

This invention relates generally to electric switches and, more particularly, to double pole, double throw switches for use in selectively controlling energization of either a first or second electric circuit.

While various designs of double pole, double throw switches are currently in use and performing satisfactorily, they tend, generally, to be quite cumbersome and expensive. There is a need for an efficient, simplified switch of the double pole, double throw type having overcenter snap action and contact self-cleaning characteristics for use in combination with permanent magnet motors in various vehicular applications, such as rear vent, door lock, seat back, and sunroof actuators.

Accordingly, a general object of the invention is to provide an improved double pole, double throw electric switch which includes the above-mentioned features.

Another object of the invention is to provide an improved electric switch which includes two sets of three terminals, with a contact strip operatively connected between each set of terminals and an actuator member for universal movement with respect to the middle terminal of each set, i.e., moveable in response to initial movement of the actuator member to selectively cause one of the contact strips to pivot overcenter on the second terminal in one plane into engagement with the first or third terminal to thereby complete one of two electric circuits, and moveable in response to continued movement of the actuator member in a different plane so as to cause both contact strips to slide across the respective first or third terminals in a cleaning action.

A further object of the invention is to provide a double pole, double throw switch for use in selectively controlling energization of either a first or second electric circuit, wherein the switch includes two sets of first, second and third terminals mounted on oppositely disposed sidewalls, with each of the second terminals being offset in opposite directions from one another, a pivotally mounted actuator button, and a pair of legs formed on the inner portion of the actuator button for carrying first and second contact strips, the latter being mounted for universal movement with respect to the second terminals so as to normally contact respective opposite first or third terminals. The legs are moveable in response to initial movement of the actuator button in either direction so as to selectively cause one of the first and second contact strips to pivot overcenter on the second terminal in a plane normal to the sidewalls into engagement with the other of the first or third terminals to provide a conductive path between respective first or third terminals and thereby complete one of the first or second electric circuits. The legs are further moveable in response to continued movement of the actuator button to cause the first and second contact strips to pivot about the second terminals in a plane parallel to the sidewalls so as to slide across the conducting surfaces of the respective first or third terminals in a cleaning action.

BRIEF DESCRIPTION OF THE DRAWINGS

These and other objects and advantages of the invention will be apparent when reference is made to the following description and accompanying drawings, wherein.

DESCRIPTION OF THE PREFERRED EMBODIMENT

Figure 1:
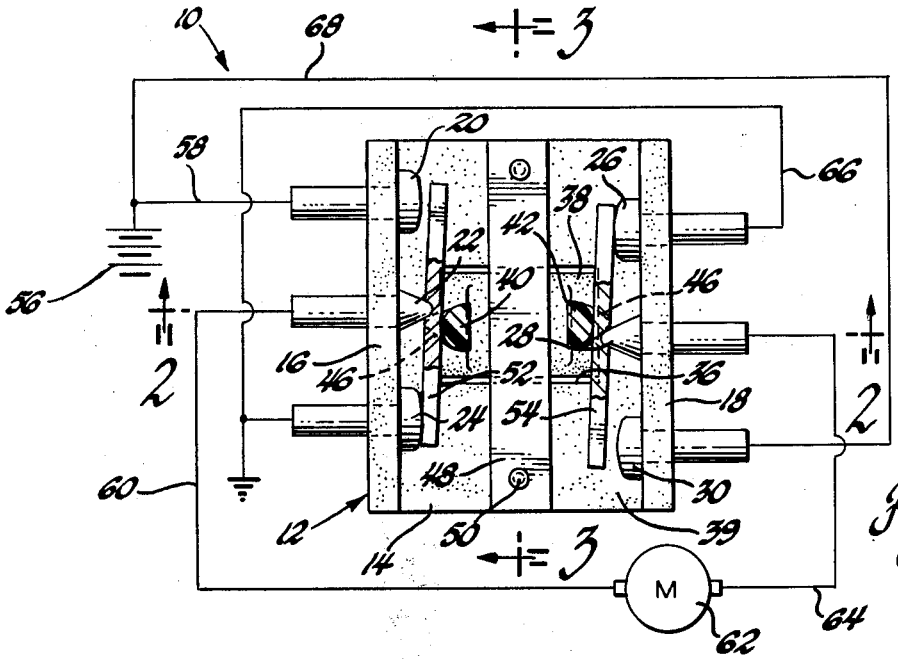
FIG. 1 is a bottom view of an electric switch arrangement embodying the invention and illustrating a typical circuit therefore.
Figure 2:
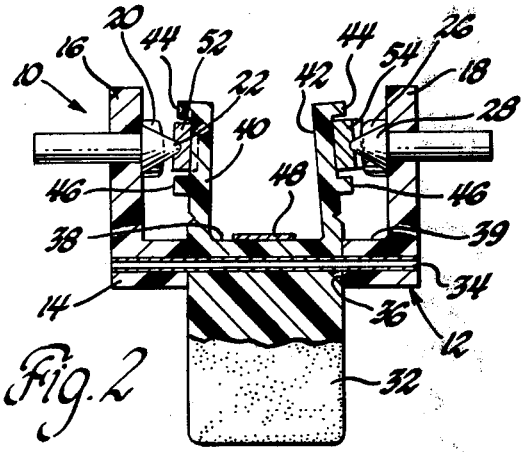
FIG. 2 is a cross-sectional view taken along the plane of the line 2—2 of FIG. 1, and looking in the direction of the arrows.
Figure 3:
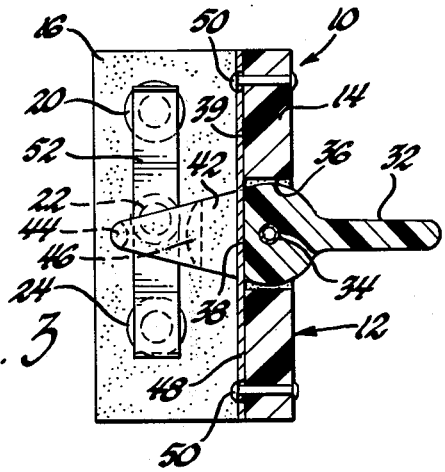
FIG. 3 is a cross-sectional view taken along the plane of the line 3—3 of FIG. 1, and looking in the direction of the arrows.

Referring now to the drawings in greater detail, FIGS. 1–3 illustrate a double pole, double throw switch arrangement 10, including a housing 12 having a base member 14 and oppositely disposed sidewalls 16 and 18. First, second and third terminals 20, 22 and 24 and 26, 28 and 30, respectively, are carried by each of the sidewalls, the terminals being spaced apart from each other and each having a conducting surface facing interiorly of the housing 12. The oppositely disposed second terminals 22 and 28 are offset in opposite directions from the longitudinal center of the respective sidewalls 16 and 18.

An actuator button 32 (FIG. 3) is pivotally mounted via a pivot pin 34 in a centrally located opening 36 formed in the base member 14. A flat surface 38 is formed on the actuator button 32 so as to be substantially coplanar with the inner surface 39 of the base member 14. A pair of leg members 40 and 42 (FIG. 2) are formed on oppositely disposed ends of the flat surface 38 and extend inwardly into the housing 12 intermediate the sidewalls 16 and 18. Spaced retainer ribs 44 and 46 are formed adjacent the ends of each leg member, on the outer surface thereof.

Figure 4:
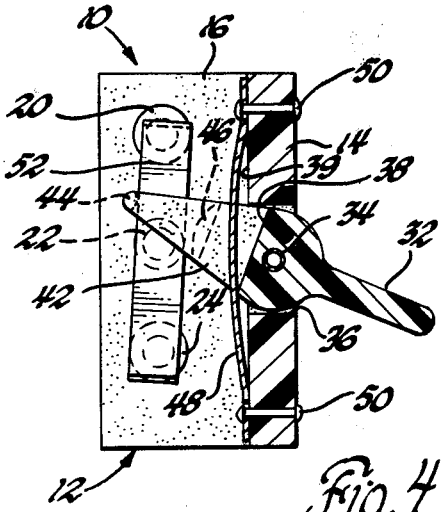
FIGS. 4 and 5 are views similar to FIG. 3 illustrating two different operational conditions.
Figure 5:
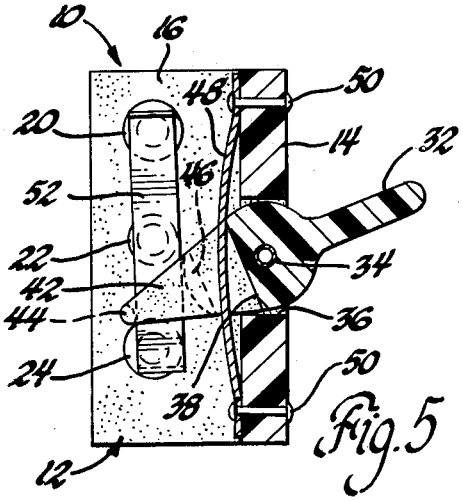

A leaf spring 48 is secured by rivets 50 along the inner surface 39 of the base member 14 between the leg members 40 and 42, in contact with the flat surface 38 of the actuator button 32, urging the actuator button into an upright position, as may be noted in FIGS. 3–5.

First and second contact strips 52 and 54 are carried by the respective oppositely disposed spaced retainer ribs 44 and 46 of the actuator legs 40 and 42 and mounted for universal movement with respect to the second or center terminals 22 and 28 so as to normally contact respective opposite first and third terminals 26 and 24, respectively, as shown in FIG. 1.

As may be noted from FIGS. 1, 4 and 5, as the legs 40 and 42 are moved in either lateral direction in response to initial movement of the actuator button 32, by virtue of the offset center terminals 22 and 28, they selectively cause only one or the other of the first or second contact strips 52 and 54 to pivot overcenter on its respective center terminal 22 or 28 in a plane normal to the sidewalls 16 and 18 and into engagement with the other of first or third terminals 20 or 30, respectively, to provide a conductive path between respective first (20 and 26) or third (24 and 30) terminals, and thereby completing one of two possible electrical circuits. For example, with the two contact strips 52 and 54 in contact with the oppositely disposed first terminals 20 and 26, it may be noted that the circuit would be complete in FIG. 1 from a battery 56 via a line 58 to the terminal 20, and thence via the contact strip 52 to the second terminal 22 and the line 60 leading to a permanent magnet motor 62. A line 64 connects between the motor 62 and the other center terminal 28, thence to the other contact strip 54 and the other first terminal 26, to a line 66 leading to ground, completing the circuit. With the two contact strips 52 and 54 in contact with the oppositely disposed third terminals 24 and 30, it is apparent that the circuit would be complete via the battery 56, a line 68, the third terminal 30, the contact strip 54, the second terminal 28, the line 64, the motor 62 (causing the latter to run in the opposite direction), the line 60, the other second terminal 22, the other contact strip 52, and the other third terminal 24 to ground.

It may be noted from FIGS. 2, 4 and 5, that, after the initial movement of the legs 40 and 42 in response to the initial movement of the actuator button 32 which results in the completion of the electric circuit described above, continued movement of the button 32 further pivots the legs 40 and 42, and causes the ribs 44 and 46 to urge both of the contact strips 52 and 54 in a pivotal movement about the respective center terminals 22 and 28 toward the base member 14, thus causing the respective first and second contact strips to pivot in a plane parallel to the sidewalls, i.e., in a clockwise direction in FIG. 4 and in a counter-clockwise direction in FIG. 5. This causes the contact strips 52 and 54 to slide across the conducting surfaces of the respective first (26 and 20) or third (30 and 24) terminals, producing a cleaning action of those conducting surfaces.

It should be apparent that the invention provides an improved double pole, double throw switch which quickly completes one of two electric circuits in an overcenter snap action of two contact strips, and then proceeds to efficiently self clean the conducting surfaces which are engaged thereby.

While but one embodiment of the invention has been shown and described, other modifications thereof are possible.

The embodiments of the invention in which an exclusive property or privilege is claimed are defined as follows:

1. An electric switch for use in selectively controlling energization of either a first or second electric circuit, said switch comprising a housing having a base member and oppositely disposed side walls, first, second and third terminals carried by each of said side walls, said terminals being spaced from each other and each having a conducting surface facing interiorly of said housing with each of said second terminals being offset in opposite directions from the longitudinal centers of said respective side walls, actuator means pivotally mounted in said base member, resilient means operatively connected to said base member for urging said actuator means into an upright position, retainer means formed on said actuator means and extending interiorly of said housing, first and second contact strips carried by said retainer means and mounted for universal movement with respect to said second terminals so as to normally contact respective opposite first or third terminals, said retainer means being moveable in response to initial movement of said actuator means in either direction so as to selectively cause one of said first and second contact strips to pivot overcenter on said second terminal in a plane normal to said side walls and into engagement with the other of the first or third terminals to provide a conductive path between respective first or third terminals and thereby complete one of said first or second electric circuits, and said retainer means causing said first and second contact strips to pivot in a plane parallel to said side walls and slide across the conducting surfaces of the respective first or third terminals in a cleaning action in response to continued movement of said actuator means.

2. An electric switch for use in selectively controlling energization of either a first or second electric circuit, said switch comprising a housing having a base member, an opening formed in the base member, and oppositely disposed side walls, first, second and third terminals carried by each of said side walls, said terminals being spaced from each other and each having a conducting surface facing interiorly of said housing with each of said second terminals being offset in opposite directions from the longitudinal centers of said respective side walls, an actuator button pivotally mounted in said opening in the base member, a flat surface formed on said actuator button just inside the inner surface of said base member, a leaf spring secured at the ends thereof to said inner surface for abutting against said flat surface for urging said actuator button into an upright position, a pair of legs formed on oppositely disposed ends of said flat surface straddling said leaf spring and extending interiorly of said housing, a pair of spaced retainer ribs formed on the outer surface of each leg adjacent the end thereof, first and second contact strips carried by said respective pairs of spaced retainer ribs and mounted for universal movement with respect to said second terminals so as to normally contact respective opposite first or third terminals, said legs and retainer ribs being moveable in response to initial movement of said actuator button in either direction so as to selectively cause one of said first and second contact strips to pivot overcenter on said second terminal in a plane normal to said side walls and into engagement with the other of the first or third terminals to provide a conductive path between respective first or third terminals and thereby complete one of said first or second electric circuits, and said retainer ribs causing said first and second contact strips to pivot in a plane parallel to said side walls and slide across the conducting surfaces of the respective first or third terminals in a cleaning action in response to continued movement of said actuator button.

* * * * *